US006205969B1

(12) United States Patent
McArthy

(10) Patent No.: US 6,205,969 B1
(45) Date of Patent: Mar. 27, 2001

(54) MULTI-SEAL RETAINER ASSEMBLY AND METHOD FOR MAKING THE SAME

(75) Inventor: Troy D. McArthy, Kendallville, IN (US)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 09/470,005

(22) Filed: Dec. 22, 1999

(51) Int. Cl.[7] ..... F02N 3/00
(52) U.S. Cl. ..... 123/188.6; 29/888.3
(58) Field of Search ..... 123/188.6; 29/888.3; 277/502

(56) References Cited

U.S. PATENT DOCUMENTS

| | | | | |
|---|---|---|---|---|
| 1,714,954 | | 5/1929 | Hanson et al. . | |
| 4,822,061 | | 4/1989 | Kammeraad | 277/181 |
| 4,834,037 | | 5/1989 | Lafever | 123/188 |
| 4,947,811 | * | 8/1990 | Binford | 123/188.6 |
| 5,003,958 | | 4/1991 | Yoneyama et al. | 123/635 |
| 5,174,256 | * | 12/1992 | Binford | 123/188.6 |
| 5,558,056 | | 9/1996 | Sakata | 123/188.6 |
| 5,775,284 | * | 7/1998 | Kirchner et al. | 123/188.6 |
| 6,123,054 | * | 9/2000 | Netzer | 123/188.6 |

* cited by examiner

*Primary Examiner*—Willis R. Wolfe
*Assistant Examiner*—Hai Huynh
(74) *Attorney, Agent, or Firm*—Rader, Fishman & Grauer PLLC

(57) ABSTRACT

A multi-seal retainer assembly is provided that is suitable for use in connection with a valve assembly for an internal combustion engine. The retainer assembly includes a plurality of valve stem seals and at least one connector, wherein the connector is connected to two adjacent valve stem seals to form a linkage or a web of valve steam seals. The connectors may contain one or more handling portions to improve manual of mechanical handling of the assembly. Further, the configuration of the retainer assembly may be designed to correspond to the valve guide configuration of a specific engine head. A method for making the retainer assembly in accordance with the principles of the invention is also disclosed.

20 Claims, 2 Drawing Sheets

MULTI-SEAL RETAINER ASSEMBLY AND METHOD FOR MAKING THE SAME

FIELD OF THE INVENTION

The present invention generally relates to valve assemblies. More particularly, the present invention relates to multi-seal retainer assemblies that are suitable for use in connection with a valve assembly for an internal combustion engine. The present invention also includes a method for making such a multi-seal retainer assembly.

BACKGROUND OF THE INVENTION

A valve assembly for an internal combustion engine generally includes a valve spring and a valve seal having a retainer. Before the valve spring and the retainer fit into place, a valve seal is usually positioned over a valve stem. Valve stem seals control the amount of oil allowed between a valve stem and a valve stem guide. The seal functions in the manner of a positive seal or umbrella seal to prevent oil from flowing down the valve stem into the combustion chamber. The spring, which normally acts to keep the valve closed, is held in place by an individual retainer that is secured onto the valve stem. Such retainers typically prevent the valve spring from wearing into the engine head surface.

While the use of plastic retainers in connection with internal combustion engines is known in the art, there exists a need for an improved combination of valve stem seals. More particularly, there exists a need for a multi-seal retainer assembly for a multi-valve assembly that is easy to produce, involves a fairly tidy and repeatable process, reduces the number of engine components, and makes the components that are used easier to handle and assemble with respect to a particular engine head configuration.

SUMMARY OF THE INVENTION

The present invention recognizes the limitations associated with currently available multi-seal assemblies and the production of such assemblies. The present invention provides an assembly wherein individual valve seals are connected into a single assembly unit. Rather than providing individual seals for each valve stem, a molded assembly can be used to seal all of the valve stems on a head of an engine. The assembly can be designed for a particular engine head with valve guide spacing having various angles. Further, such a multi-seal retainer assembly will generally function to hold or retain the rubber portion of the individual seals and to act as a type of valve spring washer to prevent the valve spring from wearing into the head surface of an engine.

The present invention provides several advantages over conventional valve assemblies including, among other things, improved functionality, ease of manufacture, and convenient implementation and use. For instance, by forming a single multi-seal retainer assembly comprised of a plurality of seals, the number of component parts in an engine can be reduced, thereby streamlining the assembly process. Moreover, the multi-seal retainer assembly of the present invention may be tailored to specific engine head configurations to further improve the assembly process. Also, if desired, the retainer assembly can be formed to include one or more handle portions, thereby making the assembly easier to handle and assemble in connection with a valve assembly.

In accordance with an embodiment of the invention, a multi-seal retainer assembly is provided that is suitable for use in connection with a valve assembly for an internal combustion engine. The retainer assembly includes a plurality of valve stem seals and at least one connector, wherein each connector is used to connect or link one seal to another to form a type of linkage or web of valve stem seals. A method for making a multi-seal retainer assembly as described above is also disclosed.

BRIEF DESCRIPTIONS OF THE DRAWINGS

The features and inventive aspects of the present invention will become more apparent upon reading the following detailed description, claims, and drawings, of which the following is a brief description:

DETAILED DESCRIPTION OF PREFERRED EMBODIMENT

Figure 1:
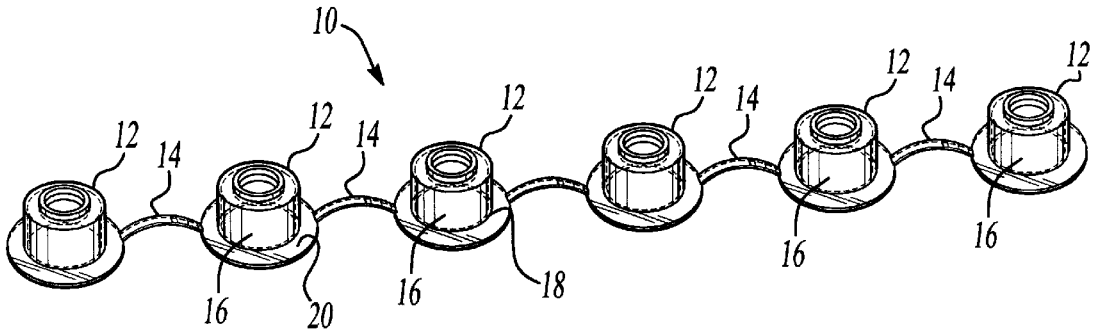
FIG. 1 is a perspective view of an embodiment of a multi-seal retainer assembly constructed in accordance with the principles of the present invention.
Figure 2:
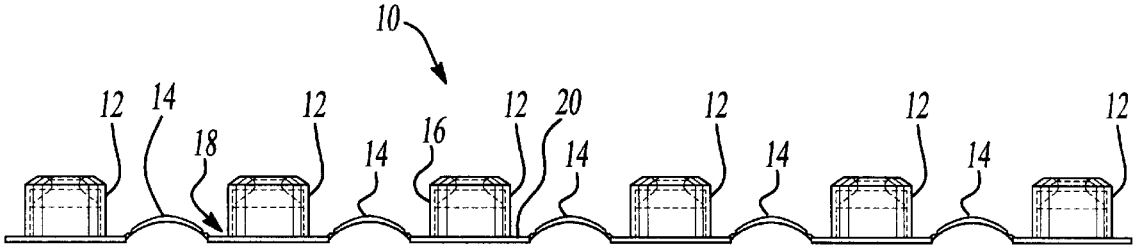
FIG. 2 is front elevation view of the assembly shown in FIG. 1.

Referring to FIG. 1, a perspective view of a preferred embodiment of a multi-seal retainer assembly 10 is shown. In accordance with the present invention, a retainer assembly 10 is provided that includes a plurality of valve stem seals 12 and at least one connector 14. Preferably, each connector 14 is used to connect or link one individual valve stem seal 12 to another to form a linkage or web of valve stem seals. FIG. 2 shows a front elevation view of the retainer assembly shown in FIG. 1.

In a preferred embodiment, the individual seals 12 have a form or shape that generally resembles a top hat comprised of an upper portion 16 and a lower portion 18. Preferably the lower portion includes an annular portion 20 that extends outwardly in a radial direction from the upper portion. However, it should be noted that the shape or form of the seals 12 is not critical to the practice of the present invention and, provided the seals 12 can provide the necessary function, each individual seal 12 may by formed in any conventional configuration.

Figure 3:
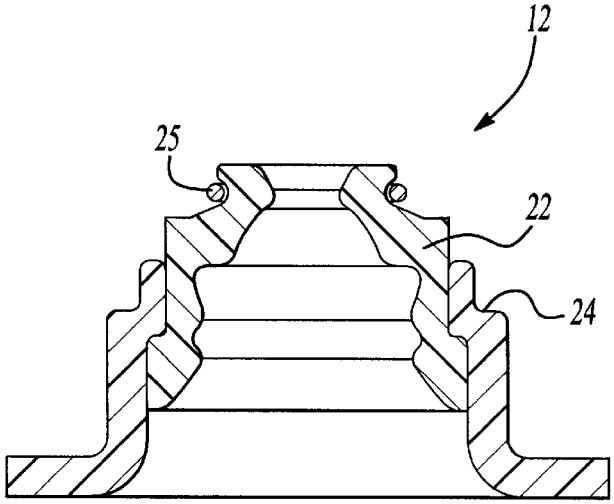
FIG. 3 is cross sectional side elevation view of an embodiment of an individual seal.

FIG. 3 illustrates another preferred embodiment of an individual seal 12. In this particular embodiment, a seal having a central axis A is comprised of at least two separate components that are commonly referred to as a jacket 22 and a retainer 24.

Figure 4:
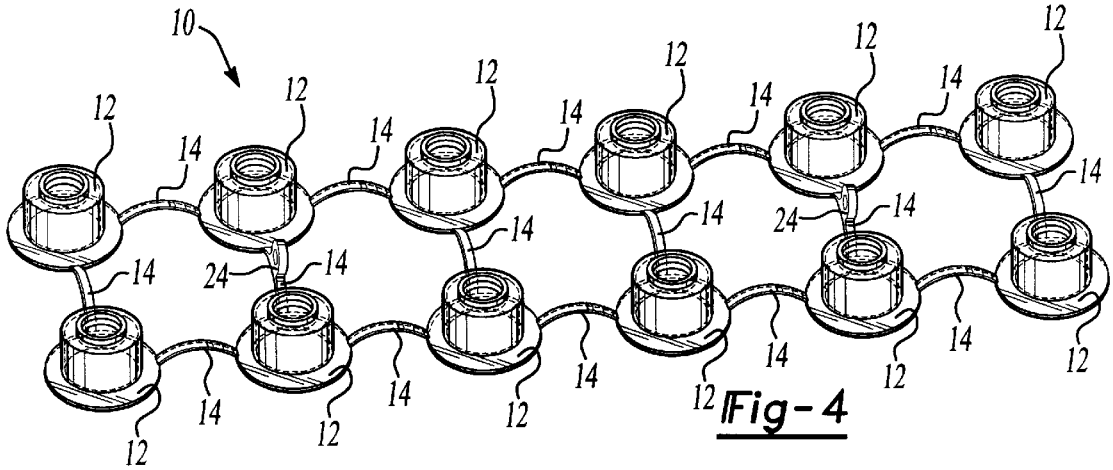
FIG. 4 is a perspective view of another embodiment of a multi-seal retainer assembly constructed in accordance with the principles of the present invention.

In the illustrated form shown in FIGS. 1 and 2, the seals 12 and connectors 14 are connected or joined in a linear chain or succession. However, the present invention is not limited to a specific configuration and provides an assembly 10 that can be tailored and prefabricated for use in connection with a number of different engine head designs. For instance, an assembly 10 with a configuration of the type shown in FIGS. 1 and 2 can be used in connection with a 6-cylinder engine having two valves per cylinder. Likewise, further embodiments of the present invention can be used in connection with various other engine head designs. By way of example, and without limitation, the assembly 10 shown in FIG. 4 can be designed to include a valve stem seal 12 configuration for an entirely different 6-cylinder engine, i.e., one that has four valves per cylinder. The ability to tailor the retainer assembly 10 to a particular valve assembly provides a number of manufacturing and assembly-related benefits and advantages.

Figure 5:
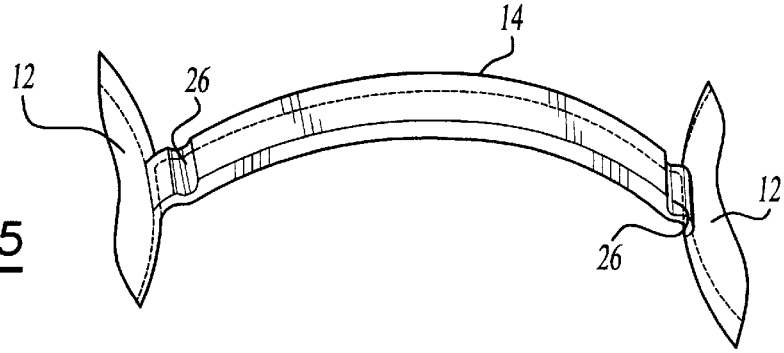
FIG. 5 is an enlarged perspective view of an embodiment of a connector positioned between portions of two valve stem seals.
Figure 6:
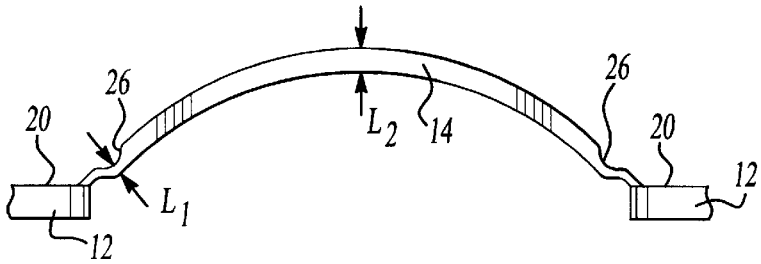
FIG. 6 is an enlarged front elevation view of the connector shown in FIG. 4.

The connectors 14 are primarily used to connect or link two individual valve stem seals 12, although as further described herein, other functions are also contemplated. FIG. 5 is an enlarged perspective view of a connector 14 formed in accordance with a preferred embodiment of the present invention. The connector 14 is shown connecting lower annular portions 20 of two adjacent seals 12. FIG. 6 is simply a front elevation view of the connector 14 depicted in FIG. 5.

In accordance with another aspect of the present invention, the connector 14 may include at least one thinned portion 26—and more preferably—at least two such thinned portions 26. The thinned portions 26 serve to allow the assembly to be more easily separated into sub-assemblies and/or for the replacement of an individual seal 12. The cross-sectional area of the thinned portion 26 of the connector 14 is generally less than that of the other cross sections of the connector 14. In a preferred embodiment, the connector includes a thinned portion 26 that has a generally semicircular shape in which the length $L_1$ of the cross sectional area of the thinned portion 26 taken through said semicircular formation is less than 75%, and more preferably less than one-half, of the length $L_2$ of the cross sectional area taken through the thickest portion of the connector 14. While the thinned portions 26 may be positioned at any location upon the connector 26, the portions 26 are preferably positioned in close proximity or substantially adjacent to the point at which the connector meets the seal 12.

Figure 7:
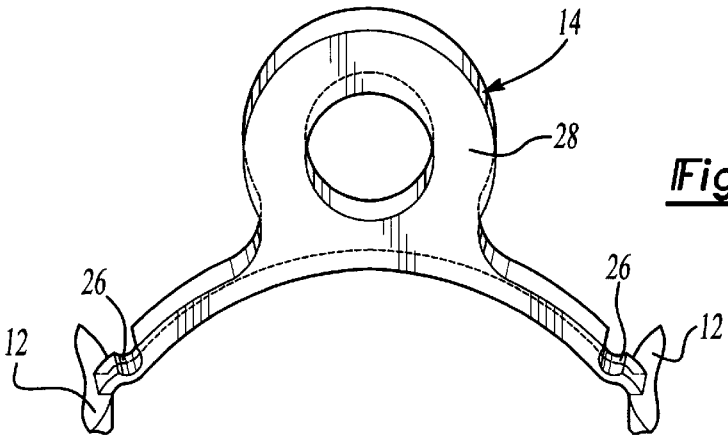
FIG. 7 is an enlarged perspective view of another embodiment of a connector that includes a handling portion.

In accordance with another important feature of the present invention, the connectors 14 of the retainer assembly 10 may additionally include one or more handling portions 28. An enlarged perspective view of another embodiment of a connector that includes a handling portion 28 is provided in FIG. 7. A handling portion 28 can be included with one or more of the connectors 14 to provide for improved manual and/or mechanical handling of the retainer assembly 10. While the portion 28 is not limited to a particular design and may take on any form that does not interfere with the functioning of the component and provides a means for handling the retainer assembly 10.

In a preferred embodiment, the valve stem seals 12 and connectors 14 are comprised of plastic. A number of types of conventional plastic materials can used to form the retainer assembly 10. However, any such plastic material must be capable of withstanding and properly operating in the intended environment. In the case of an internal combustion engine, the assembly 10 must be capable of properly operating in elevated temperature and pressure ranges.

When desired, a rubber sealing lip can be molded separately and then assembled to the retainer assembly 10. Alternatively, the plastic retainer assembly 10 can be molded to a rubber sealing grommet. A further possibility is to simply mold the two materials together, for example, by co-extruding them.

A preferred method for making a retaining assembly 10 in accordance with the present invention includes the steps of: (a) providing a multi-cavity mold for producing plastic parts, and (b) molding a plurality of valve stem seals 12 having at least one connector 14 connected to two adjacent valve stem seals 12. The multi-cavity mold can be of a conventional split-mold design or any other conventional type that is capable of forming the desired configuration of the retainer assembly 10 in a dimensionally-reliable and repeatable fashion. While injection molding and compression molding are preferred processes, other conventional plastic molding processes are also contemplated for forming the retainer assembly 10. Further, when a plastic injection molding process is involved the connectors 14 can serve as the sprue for the plastic flow from one cavity to another.

In a slightly different embodiment of the present invention, seal such as those illustrated in FIG. 3 are assembled. By way of example, and without limitation, a jacket 22 can be formed in a separate process and then assembled with a retainer 24 to form a seal 12, which can thereafter be connected to one or more other seals 12 to form an assembly 10.

Although certain preferred embodiments of the present invention have been described, the invention is not limited to the illustrations described and shown herein, which are deemed to be merely illustrative of the best modes of carrying out the invention. A person of ordinary skill in the art will realize that certain modifications and variations will come within the teachings of this invention and that such variations and modifications are within its spirit and the scope as defined by the claims.

What is claimed is:

1. A multi-seal retainer assembly that is suitable for use in connection with a valve assembly for an internal combustion engine, said retainer assembly including:

a plurality of valve stem seals; and at least one connector;

wherein said connector is connected to two adjacent valve stem seals.

2. A retainer assembly as recited in claim 1, wherein the configuration of said assembly is designed to correspond to the valve guide configuration of a specific engine head.

3. A retainer assembly as recited in claim 1, wherein said valve stem seals and said connector are comprised of a plastic material.

4. A retainer assembly as recited in claim 1, wherein said seals and said connectors are integrally formed.

5. A retainer assembly as recited in claim 1, wherein said connector is substantially flat.

6. A retainer assembly as recited in claim 1, wherein at least a portion of said connector is curved.

7. A retainer assembly as recited in claim 1, wherein a portion of said connector has a cross-sectional area that is less than seventy-five percent that of the cross sectional area of the thickest portion of said connector.

8. A retainer assembly as recited in claim 1, wherein said connector includes a handling portion.

9. A retainer assembly as recited in claim 8, wherein said handling portion is integrally formed with said connector and facilitates the handling of the assembly.

10. A retainer assembly as recited in claim 1, wherein a plurality of valve stem seals are configured in a generally linear succession and each of said valve stem seals is connected to at least one connector.

11. A retainer assembly as recited in claim 1, wherein at least one valve stem seal is connected to at least two adjacent valve stem seals by two or more connectors.

12. A retainer assembly as recited in claim 1, including a flexible elastomeric lip.

13. A retainer assembly as recited in claim 12, wherein said elastomeric lip is separately molded from the remainder of the retainer assembly.

14. A multi-seal retainer assembly that is suitable for use in connection with a valve assembly for an internal combustion engine, said retainer assembly including:

a plurality of valve stem seals; and at least one connector;

wherein said connector is connected to two adjacent valve stem seals; and wherein said seals and connector are comprised of plastic and are integrally formed.

15. A retainer assembly as recited in claim 14, wherein said connector includes a handling portion that is integrally formed with said connector and facilitates the handling of the assembly.

16. A method for making a plastic multi-seal retainer assembly that is suitable for use in connection with a valve assembly for an internal combustion engine, said method including the steps of:

providing a multi-cavity mold for producing plastic parts; and molding a plurality of valve stem seals and at least one connector;

wherein said connector is connected to two adjacent valve stem seals.

17. A method as recited in claim 16, including the step of adding a handling portion.

18. A method as recited in claim 17, wherein said adding step includes the step of integrally forming said handling portion with said connector.

19. A method as recited in claim 17, including the step of using said handling portion as a sprue for the flow of plastic material from one mold to cavity to another.

20. A method as recited in claim 16, including the step of designing the retainer assembly to function in connection with a specific engine head design.

* * * * *

UNITED STATES PATENT AND TRADEMARK OFFICE

CERTIFICATE OF CORRECTION

PATENT NO. : 6,205,969 B1
DATED : March 27, 2001
INVENTOR(S) : Troy D. McArthy

It is certified that error appears in the above-identified patent and that said Letters Patent is hereby corrected as shown below:

Column 3,
Line 65, replace "co-extruding" with -- co-injecting --.

Title page,
Item 57 ABSTRACT replace "a web of valve steam seals" with -- a web of valve stem seals --.
Item 57 ABSTRACT replace " improve manual of mechanical handling" with -- improve manual or mechanical handling --.

Signed and Sealed this

Eleventh Day of September, 2001

*Attest:*

Nicholas P. Godici

*Attesting Officer*

NICHOLAS P. GODICI
*Acting Director of the United States Patent and Trademark Office*